United States Patent [19]

Ollivier

[11] 4,358,041

[45] Nov. 9, 1982

[54] POWDER-ACTUATED TOOL WITH POWER ADJUSTMENT AND ANGLE-FIRE CONTROL

[75] Inventor: Jean Ollivier, Valence, France

[73] Assignee: Olin Corporation, New Haven, Conn.

[21] Appl. No.: 158,953

[22] Filed: Jun. 12, 1980

[51] Int. Cl.[3] ..... B25C 1/14; B25C 1/18

[52] U.S. Cl. ..... 227/10; 227/9

[58] Field of Search ..... 227/8, 9, 10, 11

[56] References Cited

U.S. PATENT DOCUMENTS

| | | | |
|---|---|---|---|
| 3,302,840 | 2/1967 | Sekiguchi et al. | 227/8 |
| 3,348,751 | 10/1967 | Henning | 227/8 |
| 3,899,113 | 8/1975 | Brack | 227/10 |

*Primary Examiner*—Paul A. Bell

*Attorney, Agent, or Firm*—Paul J. Lerner

[57] ABSTRACT

An improved indirect-acting powder-actuated fastening tool is provided wherein the power level may be continuously varied and wherein the tool may be discharged only if the muzzle is pressed against the work surface, with the tool substantially perpendicular thereto. A barrel and a barrel breech are adjustably screwed together and telescopically carried by a slide assembly which, in turn, is telescopically carried by the tool receiver. The slide assembly and the barrel are operably connected for corotation, whereby rotation of the slide assembly produces a joint axial displacement, of the barrel and the slide assembly, relative to the barrel breech, to vary the initial volume. The axial relation between the slide assembly and the barrel is thus preserved during power level adjustment and this constant relationship is utilized to effect angle-fire control by means of a firing mechanism operable solely when the slidably mounted barrel and barrel breech are urged to the battery position against the bias of a spring.

10 Claims, 4 Drawing Figures

POWDER-ACTUATED TOOL WITH POWER ADJUSTMENT AND ANGLE-FIRE CONTROL

BACKGROUND

The present invention relates to powder-actuated tools and, more particularly, to means for adjusting the power level of indirect-acting power actuated fastener driving tools.

Powder-actuated fastener driving tools, of the indirect-acting type, comprise, in general, a piston, the rear end of which slides into an expansion chamber for the gases produced by the combustion of the propelling charge.

It is known in the art to continuously adjust the power level of such tools by modifying the initial volume of the expansion chamber through relative axial displacement of two chamber-defining tool parts. Such a displacement may for example, be realized by screwing one part, including the cartridge chamber, onto another part which includes stop means defining the piston battery position.

It is also known in the art to provide a safety interlock, for such tools, preventing tool discharge unless the tool muzzle is firmly pressed against the work piece. Such an interlock may, for example, be realized by a barrel slideably carried in the tool receiver and biased toward a forward or loading position, and a firing mechanism operable only when the barrel is in a rearward or battery position. Further, the receiver, which is telescoped over the barrel, may be adapted to limit access thereto, such that rearward displacement of the barrel may be accomplished only when the tool is substantially perpendicular to the work surface. This feature is commonly known as angle-fire control and is intended to prevent discharge of the tool under conditions wherein ricochet of the fastener may occur.

Unfortunately, the above-described power adjustment technique alters the axial relation of the barrel and the receiver. It is, therefore, presently impossible to incorporate in such a tool, both the power adjustment and constant angle-fire control features.

SUMMARY OF THE INVENTION

It is a primary object of the present invention to provide an improved indirect-acting powder actuated tool, incorporating an angle-fire control, wherein the power level is continuously variable. This is accomplished, in general, by a tool wherein a barrel and a barrel breech are adjustably screwed together and telescopically carried by a slide assembly which, in turn, is telescopically carried by the tool receiver. More specifically, the slide assembly and the barrel are operably connected for corotation, whereby rotation of the slide assembly produces a joint axial displacement of the barrel and the slide assembly, relative to the barrel breech, nevertheless, are axially displaceable, relative to the sleeve assembly, between a loading position and a battery position. Thus, the axial relation between the slide assembly and the barrel is preserved during power level adjustment and this constant relationship is utilized to effect angle-fire control by means of a firing mechanism which is operable solely when the barrel and the barrel breech are in the battery position. Further, the ability of the tool to accept fasteners of differing lengths is unaffected by power adjustment. Means are provided biasing the barrel and the barrel breech toward the loading position, it being possible to overcome the biasing means by pressing the barrel muzzle against the work surface, while the tool is substantially perpendicular thereto.

BRIEF DESCRIPTION OF THE DRAWING

The above and other objects, as may hereinafter appear, may be more clearly understood by reference to the following detailed description of the preferred embodiment, the appended claims and the drawing wherein:

DESCRIPTION OF THE PREFERRED EMBODIMENT

Figure 1:
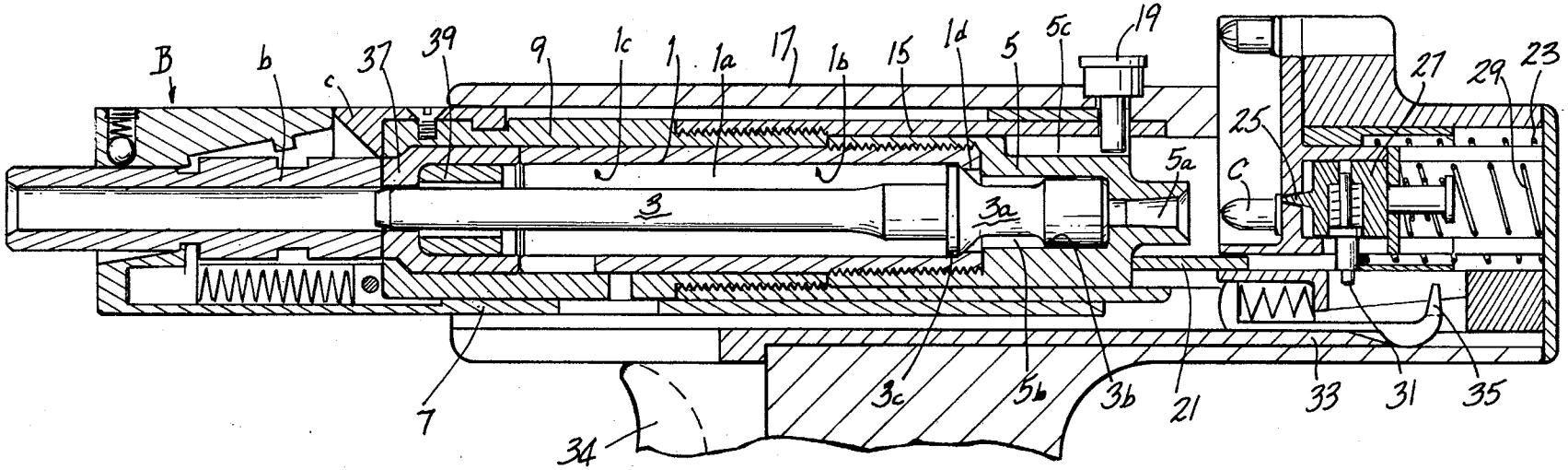
FIG. 1 is a side cross-sectional view of an indirect-acting powder-actuated fastener driving tool, arranged and constructed in accord with the present invention, wherein the barrel and barrel breech are in the loading position and adjusted for maximum power output.
Figure 2:
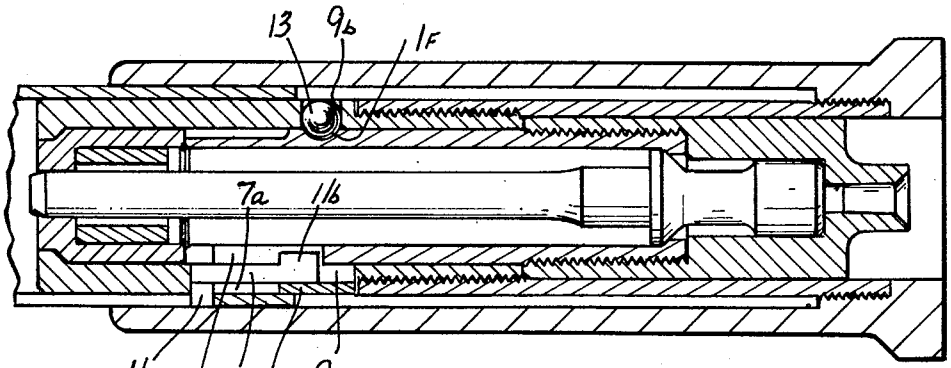
FIG. 2 is a fragmentary top cross-sectional view of the tool of FIG. 1.

In the drawing, there is shown an indirect-acting powder-actuated fastening tool including a barrel 1 having a longitudinal bore 1*a*, a breech end 1*b* and a muzzle end 1*c*. A piston 3, having a head 3*a*, is slidably disposed within the barrel bore 1*a*. A barrel breech 5 is threadedly carried on the breech end 1*b* of the barrel 1 and includes a cartridge-receiving chamber 5*a* communicating with a gas expansion chamber 5*b* adapted to receive a portion 3*b* of the piston head 3*a* in gas-tight sliding relation. An inwardly projecting lip 1*d* is provided, proximate the breech end 1*b* of the barrel 1, cooperating with a second portion 3*c* of the piston head 3*a* to limit its motion toward the cartridge-receiving chamber 5*a*.

Figure 3:
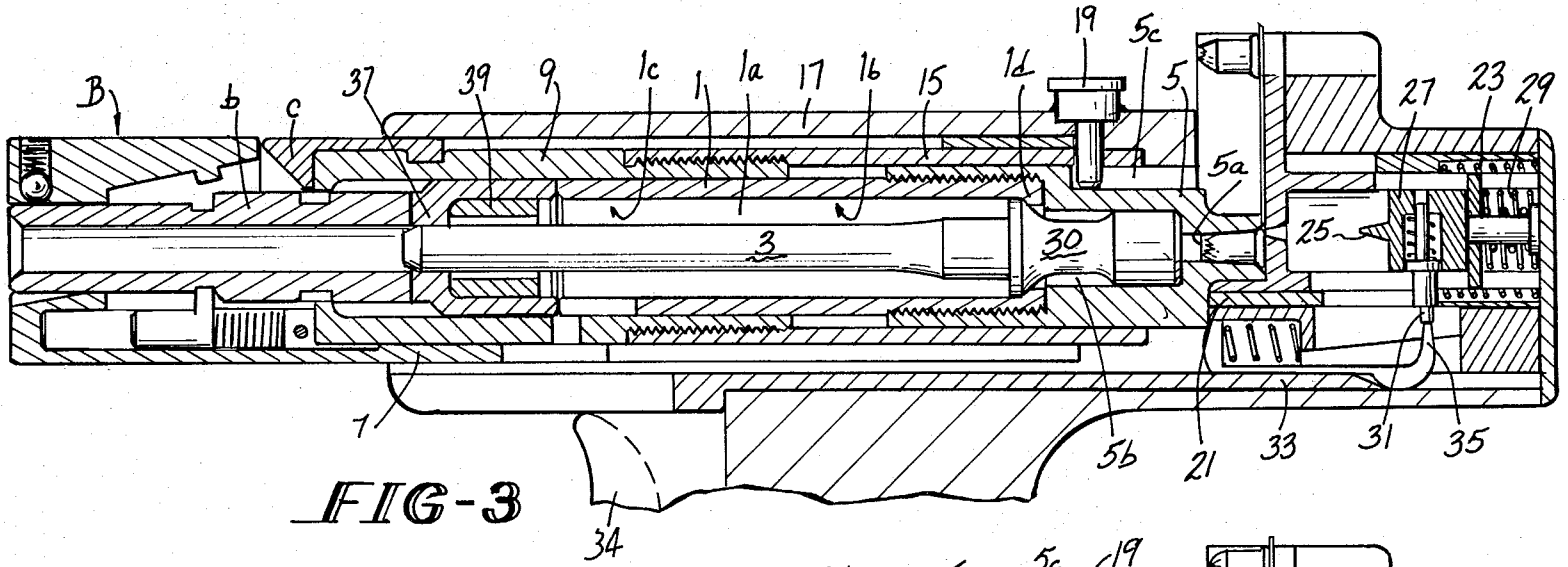
FIG. 3 is a side cross-sectional view, similar to FIG. 1, showing the tool in condition ready to be fired.

A slide assembly 7 is telescoped over the barrel 1 and the barrel breech 5, both of which are jointly axially displaceable, relative to the slide assembly 7, between a forward or cartridge loading position, as seen in FIG. 1 and a rearward or battery position, as seen in FIG. 3.

A barrel sleeve 9 is disposed intermediate the muzzle end 1*c* of the barrel 1 and the slide assembly 7, both of which are operatively connected, for reasons which will be more fully explained hereinafter, by means of a key 11, slidably carried in a longitudinal slot 9*a* in the barrel sleeve 9. Key 11 includes portions 11*a* and 11*b* extending into longitudinal slots 1*e* and 7*a* in the barrel 1 and the slide assembly 7, respectively. A spring retaining ring 12 secures the key 11 against accidental dislodgement. The barrel sleeve 9 is operably connectable to the barrel 1, during rearward repositioning of the piston 3, by means of a ball 13, carried in a bore 9*b* in the barrel sleeve 9, extendable into a recess 1*f* in the barrel 1.

A receiver sleeve 15 is disposed intermediate the breech end 1*b* of the barrel 1 and the slide assembly 7 and is threadedly carried on the barrel sleeve 9.

A slide assembly 7 is telescoped into the tool receiver 17, to which the receiver sleeve 15 is threadedly connected. A retaining screw 19 secures the receiver sleeve 15 against being unscrewed from the receiver 17 during operation of the tool and, more importantly, it engages a slot 5*c* in the barrel breech 5, whereby the same is prevented from rotating relative to the receiver 17.

The receiver 17 also supports a firing mechanism including a cocking slide 21, disposed rearwardly of the barrel breech 5, axially displaceable between a forward position, and a rearward, or cocked position, pursuant to displacement of the barrel 1 and the barrel breech 5 from the cartridge loading position to a battery position. A helical barrel spring 23 biases the cocking slide 21 toward the forward position and further serves to bias the barrel 1 and the barrel breech 5 toward the cartridge loading position.

A rebounding firing pin 25, mounted on a firing pin slide 27, is biased toward contact with a cartridge C by a helical firing pin spring 29. A spring-loaded firing pin pawl 31, carried by the firing pin slide 27, engages the cocking slide 21.

A trigger bar 33, operatively connected to a trigger 34 is disposed to rotatably displace a spring-loaded sear 35 to disengage the firing pin pawl 31 from the cocking slide 21 when the latter is in the cocked position.

Forwardly of the barrel 1, and concentric therewith, the barrel sleeve 9 supports a buffer housing 37 carrying an elastomeric buffer 39 adapted for cooperation with the portion 3*c* of the piston head 3*a* consequent to discharge of the tool.

A tiltable muzzle bushing B, of the type described in copending patent application Ser. No. 158,952, is preferrably carried by the slide assembly 7, forwardly of the buffer housing 37, and includes a member b which constitutes, in effect an axially displaceable extension of the barrel 1 and a muzzle bushing cam c which is fastened to the barrel sleeve 9.

As shown in FIG. 1, the tool is adjusted for maximum power output, with the barrel 1 screwed against the barrel breech 5. The initial volume of the gas expansion chamber 5*b* is, thus, at a minimum, while the length of the power-stroke, i.e. the distance that the piston must travel before the expansion gases may escape around the piston head, is a maximum. It is to be noted that the bore diameter of the passage past the barrel lip 1*d* is significantly greater than the diameter of the gas expansion chamber 5*b*, whereby the power stroke terminates at the chamber mouth. The barrel 1 and the barrel breech 5 are shown in the cartridge-loading position, while the cocking slide 21 and the firing pin slide 27 are in the forward position.

In FIG. 3, the tool has been cocked, preparatory to discharge, by pressing the muzzle end bushing member b against the work surface S. The barrel 1 and the barrel breech 5 have thus been axially displaced, against the influence of the cocking slide spring 23, to the battery position, whereat the cartridge receiving chamber 5*a* has telescoped over a cartridge C, while the cocking slide 21 and the firing pin slide 27 have been displaced to the cocked position. In this regard, it will be readily appreciated that the diameter of the slide assembly 7 is such as to preclude full displacement of the aforementioned parts unless the tool is substantially perpendicular to the work surface S.

Figure 4:
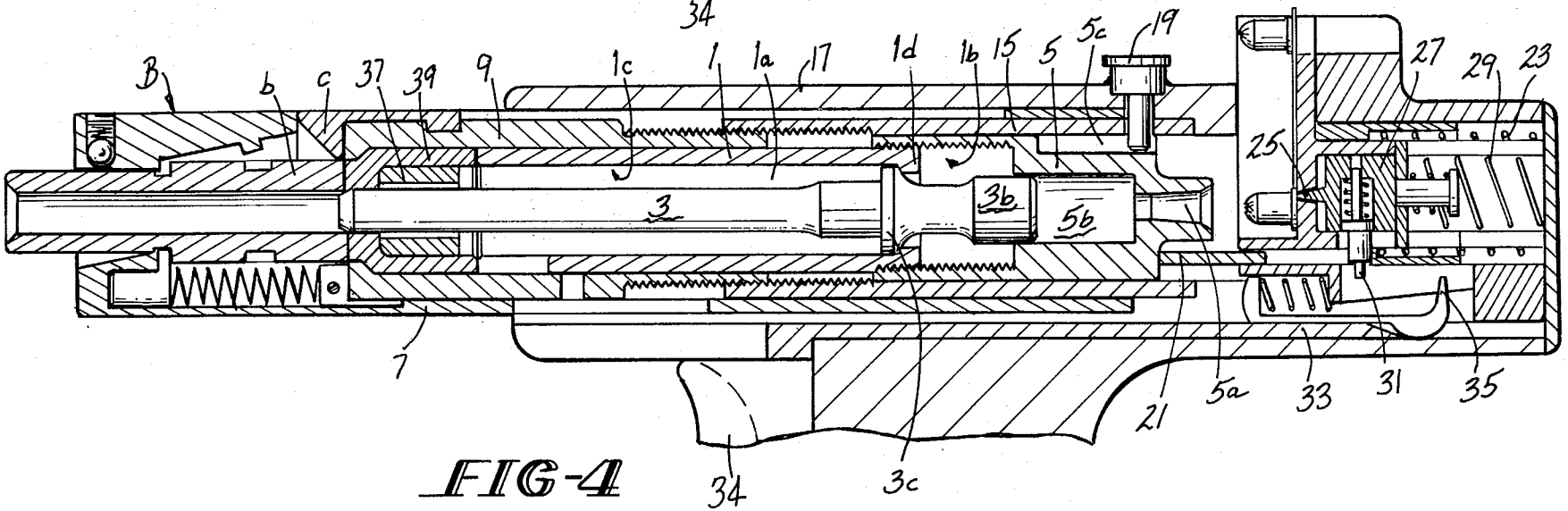
FIG. 4 is a side cross-sectional view similar to FIG. 1, wherein the tool is adjusted for minimum power output.

In FIG. 4, the tool is shown adjusted for minimum power output, with the barrel 1 unscrewed from the barrel breech 5, whereby the initial volume of the gas expansion chamber 5*b* is at a maximum and the length of the power stroke is at a minimum.

Power adjustment is effected by rotation of the slide assembly 7, which, acting through the key 11, causes the corotation of the barrel sleeve 9 and the barrel 1, relative to the barrel breech 5 and the receiver sleeve 15. This relation rotation results in the desired axial separation of the barrel 1 and the barrel breech 5, while, at the same time, effecting a corresponding axial separation of the barrel sleeve 9 and the receiver sleeve 15. It is, at this point, to be understood that the screw connections between the barrel 1 and the barrel breech 5 and between the barrel sleeve 9 and the receiver sleeve 15 have the same thread pitch.

As the barrel 1 and the barrel sleeve 9 are displaced away from the barrel breech 5 and the receiver sleeve 15, they correspondingly displace the muzzle bushing B and the slide assembly 7. Thus, the axial relation between the slide assembly 7 and the barrel 1 and bushing member b is undisturbed by power level adjustment of the tool, whereby the angle-fire control is maintained.

It is, thus, to be noted that power adjustment does not change the length of piston travel during firing and does not affect the capacity of the tool to accept fasteners of different lengths.

To disassemble the tool, as for cleaning, the retaining screw 19 is removed, freeing the barrel breech 5 for corotation with the barrel 1. The entire barrel/slide assembly, less the receiver sleeve 15 which remains attached to the receiver 17, is now unscrewed from the receiver 17 by rotation of the slide assembly 7. The slide assembly 7 is moved to its extreme forward position, allowing removal of the retaining ring 12 from the barrel sleeve 9. The key 11 is now removed and the barrel 1 and barrel breech 5 are withdrawn from the barrel sleeve 9, as may the buffer housing 37 and the buffer 39. The piston 3 is now slide from the barrel 1 and the barrel 1 and barrel breech 5 are unscrewed. Lastly, the muzzle bushing cam c is removed from the barrel sleeve 9, allowing removal of the barrel sleeve 9 from the slide assembly 7.

Reassembly is essentially accomplished in reverse order of disassembly, it being necessary, however, to insure that the retaining ring 12 does not overlie the ball 13 and that the tool parts are properly set prior to lockup. This may be readily accomplished by screwing the barrel 1 completely into the barrel breech 5. The barrel/slide assembly is inserted into the receiver sleeve 15 and screwed to its furthest breechward position and then backed off suficiently to permit insertion of the retaining screw 19 in the slot 5*c* in the barrel breech 5.

While reference has been made above to a particular embodiment of the invention, various alterations and modifications will readily suggest themselves to those skilled in the art. Accordingly, the scope of this invention is intended to be limited solely by the following claims.

I claim:

1. An improved powder-actuated tool comprising:

(a) a barrel having a longitudinal bore, a breech end and a muzzle end;

(b) a piston, having a piston head, slidably disposed in said barrel bore;

(c) a barrel breech threadedly carried on said breech end of said barrel, whereby said barrel breech and said barrel are relatively axially displaceable consequent to their relative rotation, said barrel breech including a cartridge-receiving chamber and providing, between said cartridge-receiving chamber and said piston head, a gas expansion chamber;

(d) stop means on said barrel, proximate said breech end thereof, for cooperating with said piston head to limit its motion toward said cartridge-receiving chamber;

(e) a slide assembly telescoped over said barrel and said barrel breech, said barrel and said barrel breech being jointly axially displaceable, relative to said slide assembly, between a loading position and a battery position; and (f) means operably connecting said barrel and said slide assembly for corotation, whereby rotation of said slide assembly produces an axial displacement of said stop means relative to said barrel breach, in order that the volume of said gas expansion chamber may be varied and the power level of the tool thereby adjusted.

2. The invention of claim 1, wherein said connecting means comprises:

(a) a barrel sleeve disposed intermediate said muzzle end of said barrel and said slide assembly;

(b) a receiver sleeve disposed intermediate said barrel breech and said slide assembly and threadedly connected to said barrel sleeve; and (c) key means operably connecting said slide assembly and said barrel, said key means permitting relative axial movement of said barrel and said slide assembly while also providing for corotation of said assembly, said barrel sleeve and said barrel.

3. The invention of claim 1 further comprising:

(a) a receiver telescopically carrying said slide assembly;

(b) a firing mechanism in said receiver operable solely when said barrel and said barrel breech are in said battery position; and (c) means biasing said barrel and said barrel breech toward said loading position, whereby the tool may be discharged only when said muzzle end thereof is pressed against a work surface.

4. An improved powder-actuated tool comprising:

(a) a barrel having a longitudinal bore, a breech end and a muzzle end;

(b) a piston, having a piston head, slidably disposed in said barrel bore;

(c) a barrel breech including a cartridge-receiving chamber and a gas expansion chamber adapted to slidably receive said piston head;

(d) stop means, on said barrel, limiting the extent of protrusion of said piston head from said breech end of said barrel into said gas expansion chamber;

(e) a receiver;

(f) first means adjustably connecting said barrel and said barrel breech, such that the extent of penetration of said piston head, into said gas expansion chamber, may be varied by axially displacing said barrel breech relative to said barrel, whereby the power level of the tool may be adjusted;

(g) a slide assembly telescopically carried by said receiver, said barrel and said barrel breech being telescopically carried by said slide assembly and displaceable therein between a loading position and a battery position; and (h) second means operatively connecting said slide assembly and said barrel, said second means maintaining a constant axial relation between said slide assembly and said barrel during said power level adjustment.

5. The invention of claim 4, wherein said first means comprises a male thread on one of said breech end of said barrel and said barrel breech, and a mating female thread on the other.

6. The invention of claim 4, wherein said second means comprises:

(a) a barrel sleeve disposed intermediate said muzzle end of said barrel and said slide assembly;

(b) a receiver sleeve disposed intermediate said barrel breech and said slide assembly, said receiver sleeve being adjustably connected to said barrel sleeve; and (c) third means operably connecting said slide assembly and said barrel, said third means simultaneously providing for relative axial movement thereof and for corotation of said slide assembly, said barrel sleeve and said barrel.

7. The invention of claim 6, wherein said third means comprises a key slidably carried in longitudinal slots in said sleeve assembly, said barrel sleeve and said barrel.

8. The invention of claim 4, further comprising:

(a) a firing mechanism in said receiver operable solely when said barrel and said barrel breech are in said battery position; and (b) means biasing said barrel and said barrel breech toward said loading position;

whereby the tool may be discharged only when the muzzle end thereof is pressed against the work surface.

9. An improved powder-actuated tool comprising:

(a) a barrel assembly including a longitudinal bore, a power load-receiving chamber and a middle chamber communicating therebetween;

(b) a piston, slidably disposed in said barrel bore, including a piston head adapted to enter into said middle chamber;

(c) means for adjustably controlling the extent of penetration of said piston head into said middle chamber;

(d) a slide assembly, said barrel assembly being telescopically carried by said slide assembly and axially displaceable therein between a loading position and a battery position; and (e) means operably connecting said barrel assembly and said slide assembly, said connecting means maintaining a constant axial relation between said slide assembly and the muzzle end of said barrel assembly during adjustment of said penetration controlling means.

10. A power actuated tool comprising:

(a) means forming a barrel having a bore;

(b) means forming a firing chamber communicating with a breech end of said barrel bore;

(c) a fastener-driving piston reciprocally slidably disposed in said barrel bore for movement between a breechward battery position and a muzzleward driven position;

(d) stop means in said barrel bore for contacting a breechward surface on said piston to define said battery position of said piston;

(e) means forming a muzzle end of said tool for positioning against a work surface preparatory to driving of a fastener by said tool;

(f) means for cocking said tool for firing when said muzzle end of said tool is pressed against a work surface;

(g) angle-fire control means operably associated with said muzzle end of said tool in a predetermined relationship for enabling cocking of said tool only when the axis of said barrel is substantially perpendicular to a work surface; and (h) power control means for axially displacing said stop means whereby a breechwardmost surface of said piston can be variably spaced from said firing chamber when said piston is in said battery position while maintaining said predetermined relationship between said angle-fire control means and said muzzle end of said tool to provide substantially constant angle-fire control at all power levels of the tool.

* * * * *